US006505804B1

(12) United States Patent
Francis et al.

(10) Patent No.: US 6,505,804 B1
(45) Date of Patent: Jan. 14, 2003

(54) ERGONOMIC BASE AND CHAIR PROVIDING CONSTRAINED LATERAL MOVEMENT THERE BETWEEN

(75) Inventors: Simon Leigh Francis, Sorrento (AU); Norbert Schauer, Ferny Hills (AU); Kevin Andrew Loughrey, Gymea Bay (AU)

(73) Assignee: Siros Systems Pty. Ltd., Queensland (AU)

( * ) Notice: Subject to any disclaimer, the term of this patent is extended or adjusted under 35 U.S.C. 154(b) by 0 days.

(21) Appl. No.: 09/530,742

(22) PCT Filed: Nov. 16, 1998

(86) PCT No.: PCT/AU98/00952

§ 371 (c)(1),
(2), (4) Date: Jul. 31, 2000

(87) PCT Pub. No.: WO99/25221

PCT Pub. Date: May 27, 1999

(30) Foreign Application Priority Data

Nov. 17, 1997 (AU) ..... PP0382

(51) Int. Cl.[7] ..... F16M 11/20

(52) U.S. Cl. ..... 248/429; 248/424; 248/550; 297/344.11

(58) Field of Search ..... 248/429; 482/72, 482/123, 130, 142; 297/344, 24, 344.1, 311

(56) References Cited

U.S. PATENT DOCUMENTS 3,891,269 A * 6/1975 Moeser ..... 297/252
4,671,572 A * 6/1987 Young et al.
4,699,425 A * 10/1987 Ohlson
4,766,838 A * 8/1988 Johnson ..... 114/363
5,246,270 A * 9/1993 Vogel
5,284,379 A * 2/1994 Arnold et al.
5,373,591 A * 12/1994 Myers ..... 4/560.1
5,379,701 A * 1/1995 Sumi et al.
5,636,884 A * 6/1997 Ladetto et al. ..... 296/65.1
5,740,563 A * 4/1998 Gaddy ..... 4/579
5,775,251 A * 7/1998 Morningstar ..... 114/363

FOREIGN PATENT DOCUMENTS

DE 2942610 A * 4/1981

* cited by examiner

*Primary Examiner*—Korie Chan
*Assistant Examiner*—Ingrid Weinhold
(74) *Attorney, Agent, or Firm*—Arnold B. Silverman; Brij K. Agarwal; Eckert Seamans Cherin & Mellott, LLC

(57) ABSTRACT

A base for a chair, the base comprising a chassis (11), at least one landing (20) operatively connected to the chassis; a carrier (32) for reduced friction sliding along the landing transverse to the forward facing direction of the occupant; the carrier being adapted to support a pedestal (40) upon which the chair is operatively mounted. The base may include a foot rest (14), brake means (49) to prevent sliding when the seat is not occupied and wheels between the chassis and floor to permit movement of the seat transverse to the sliding of the carrier. The wheels may be lockable. The landing may comprise an inverted U channel in which rollers slide from which the carrier may suspend underneath the chassis.

32 Claims, 9 Drawing Sheets

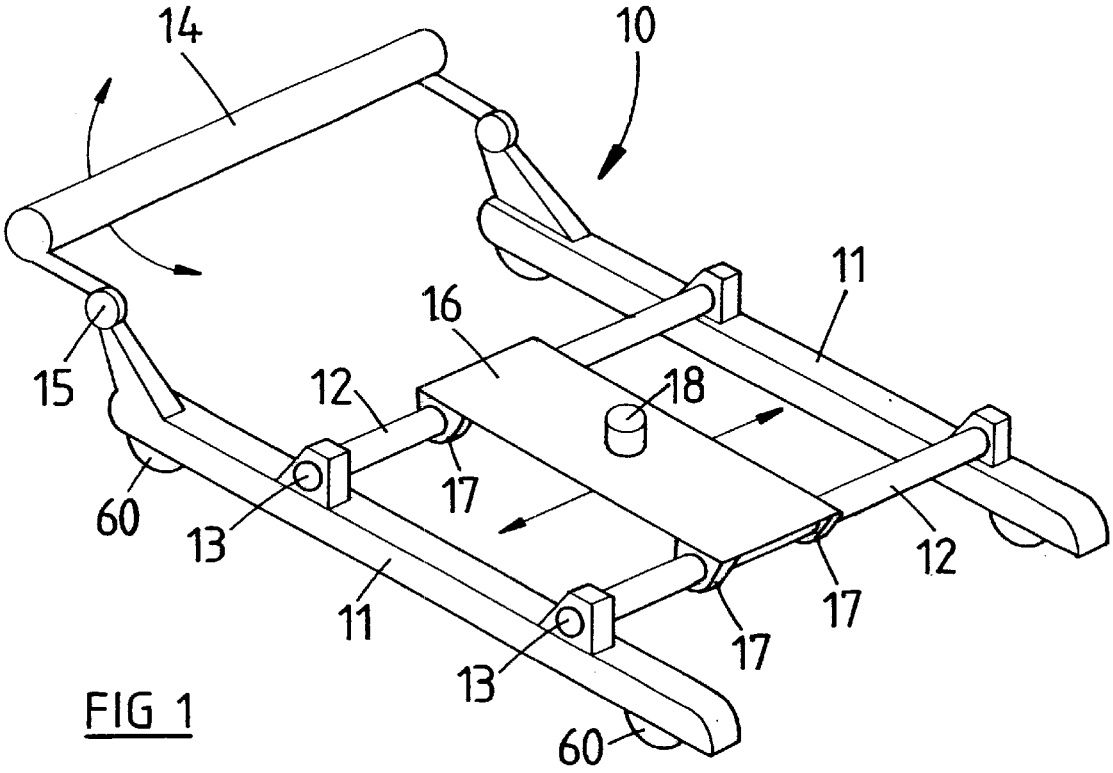
FIG 1
FIG 2
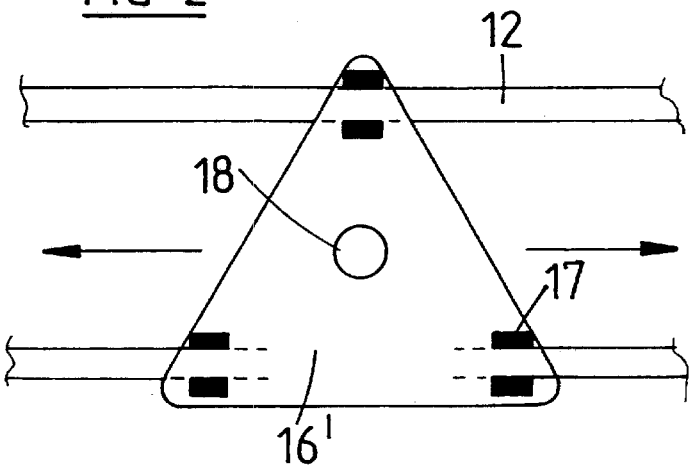

FIG 4
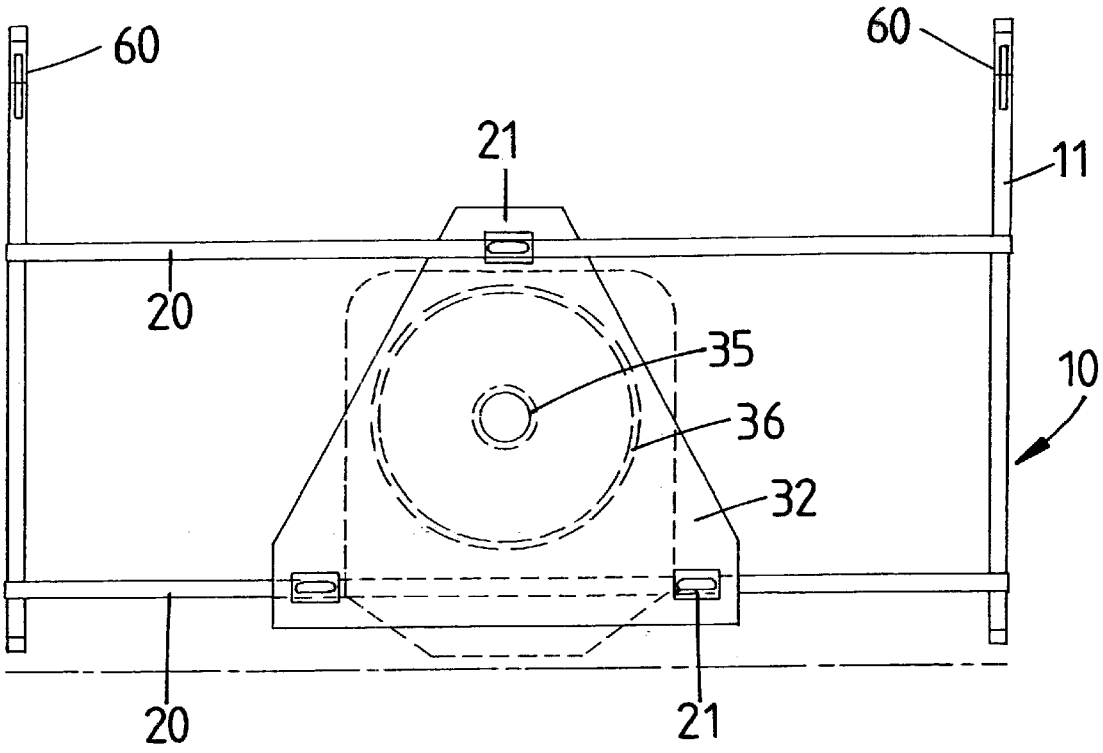
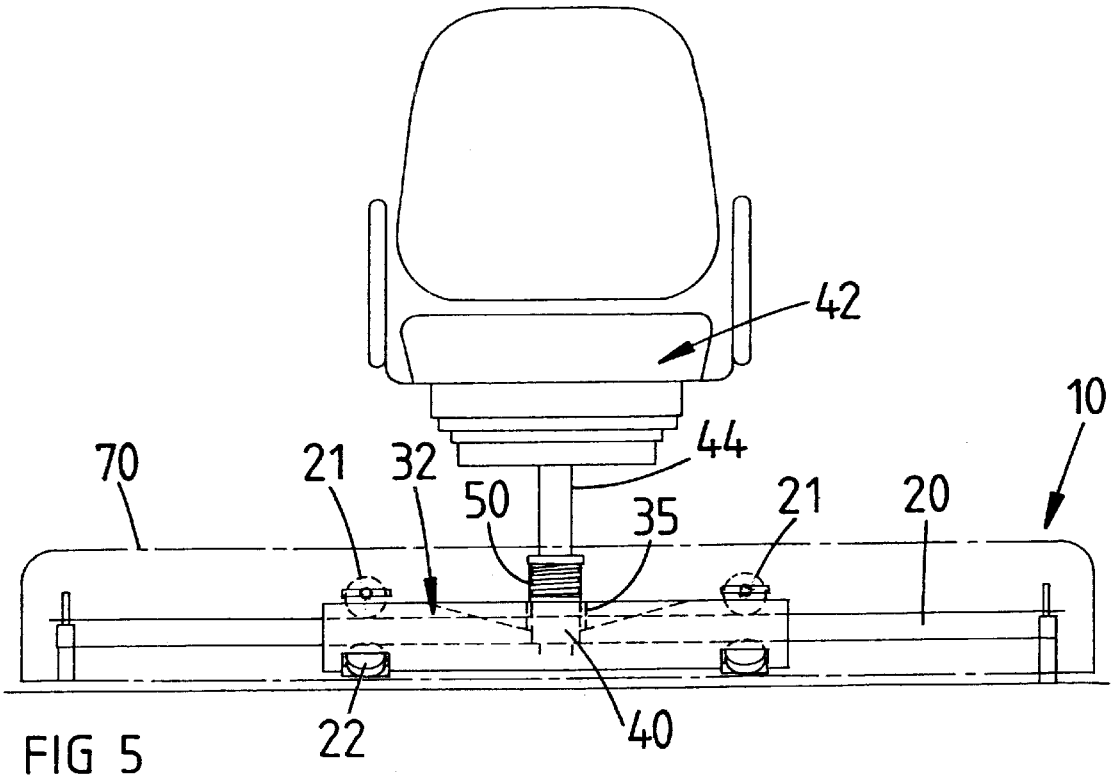
FIG 5

ERGONOMIC BASE AND CHAIR PROVIDING CONSTRAINED LATERAL MOVEMENT THERE BETWEEN

The invention relates to chairs and chair bases and more particularly to a chair and chair base for reducing back strain in occupational situations where lateral movement from a seated position is an advantage.

Many occupational situations require lateral or side to side movement in a sitting position. Dealers and croupiers in casinos, postal sorters, office workers and receptionists etc. are often required to slide from side to side in the course of their work. In a healthy individual, this kind of repetitive motion may be a source of strain or injury. In a person with an existing back injury, this kind of motion may preclude them from working effectively, or at all. As the lateral motion is accomplished largely by the base of the chair (as opposed to the seat) there exists therefore, a need for a chair, or for a chair base adapted to receive a seat, which allows the user to move laterally, with minimum effort.

It is desirable that a chair or chair base be provided that alleviates the above problems.

According to a first aspect of the invention, there is provided a base for a seat or chair comprising a chassis;

a landing provided on the chassis;

a carrier slideable in a "sideways" direction along the landing, the carrier being adapted to support or capable of supporting, a seat or chair facing or able to face, an "in" direction which is at 90° to said "sideways" direction;

a carrier braking means having a friction material that is moveable towards and away from the landing, the carrier braking means being such that the carrier can only be freely slid along the landing when the braking means is released;

the braking means being releasable by the weight of an occupied seat or chair that serves to move the friction material away from contact with the landing and thus release the braking means, which is otherwise adapted to cause the friction material to remain in contact with the landing.

The carrier braking means may include a compressible member adapted to be compressed by the weight of the occupied seat or chair to move the friction material away from contact with the landing.

The chassis may be provided with means to facilitate it being moved in opposite "in" or "out" directions. Said means may include wheels that are retractable with respect to the chassis. In particular, said means may include lockable wheels.

The landing may be defined by spaced rails.

The carrier may be supported by wheels, which are positioned on said rails to permit movement of the carrier with respect to said rails.

The invention extends to a base, as described above, in a combination wherein the carrier supports a seat or chair facing, or able to face, an "in" direction which is at 90° to said "sideways" direction.

According to a second aspect of the invention, there is provided a base for a seat or chair, the base comprising a support structure;

a carrier that is arranged on the support structure, a seat or chair being mountable on the carrier to be supported above the support structure;

a linear displacement mechanism to permit linear displacement of the carrier relative to the support structure; and a brake mechanism that is arranged between the carrier and the support structure to inhibit linear displacement of the carrier relative to the support structure, the brake mechanism being biased into an operative condition when the seat or chair is not in use and being releasable when a threshold weight bears on the carrier, said threshold weight being based on a selected minimum weight of a person envisaged using the seat or chair.

A number of wheels may be mounted on the support structure to facilitate movement of the support structure relative to a substrate. The base may include a retracting mechanism that is operable on the wheels to retract the wheels. Further, the base may include a locking mechanism that is operable on the wheels to lock the wheels against rotational movement.

The support structure may include at least two spaced, substantially parallel, elongate members, the carrier being supported on the elongate members and being displaceable along the elongate members, the elongate members being of sufficient length to provide a desired extent of movement of the carrier.

The carrier may include at least two engaging formations that are slideably engaged with respective elongate members so that the carrier is slideable with respect to the elongate members. The elongate members may be circular cylindrical and the engaging formations may be in the form of collars that are slideably mounted on the respective elongate elements.

The carrier may include at least two wheel arrangements. Each wheel arrangement may include a weight bearing roller that is rotatably engaged with a respective elongate member so that the carrier can be wheeled back and forth along the elongate members.

Each elongate member may be shaped to define an operatively upper support surface on which the respective weight bearing rollers are supported.

Each wheel arrangement may include a guide roller that is engageable with a respective elongate member to guide movement of the carrier on the elongate members.

In a further embodiment, each elongate member may define a suspension track and each wheel arrangement may define a bogey that is positioned on a respective track, the carrier being suspended from the bogeys.

According to a third aspect of the invention, there, is provided a chair that includes a base as described in the second aspect of the invention.

A base for a seat or chair and a chair in accordance with this invention may manifest itself in a variety of forms. It will be convenient hereinafter to describe in detail preferred embodiments of the invention with reference to the accompanying drawings. The purpose of this specific description is to instruct persons having an interest in the subject matter of the invention how to carry the invention into practical effect. It is to be clearly understood however that the specific nature of this description does not supersede the generality of the preceding broad description. In the drawings:

FIG. 1 is a perspective drawing of a chair base adapted to receive a chair for lateral movement;

FIG. 2 is a plan view of an alternative chair base;

FIG. 4 is a plan view of the device shown in FIG. 3;

FIG. 5 is rear elevation of the chair base shown in FIG. 3, fitted with a cover;

Figure 3:
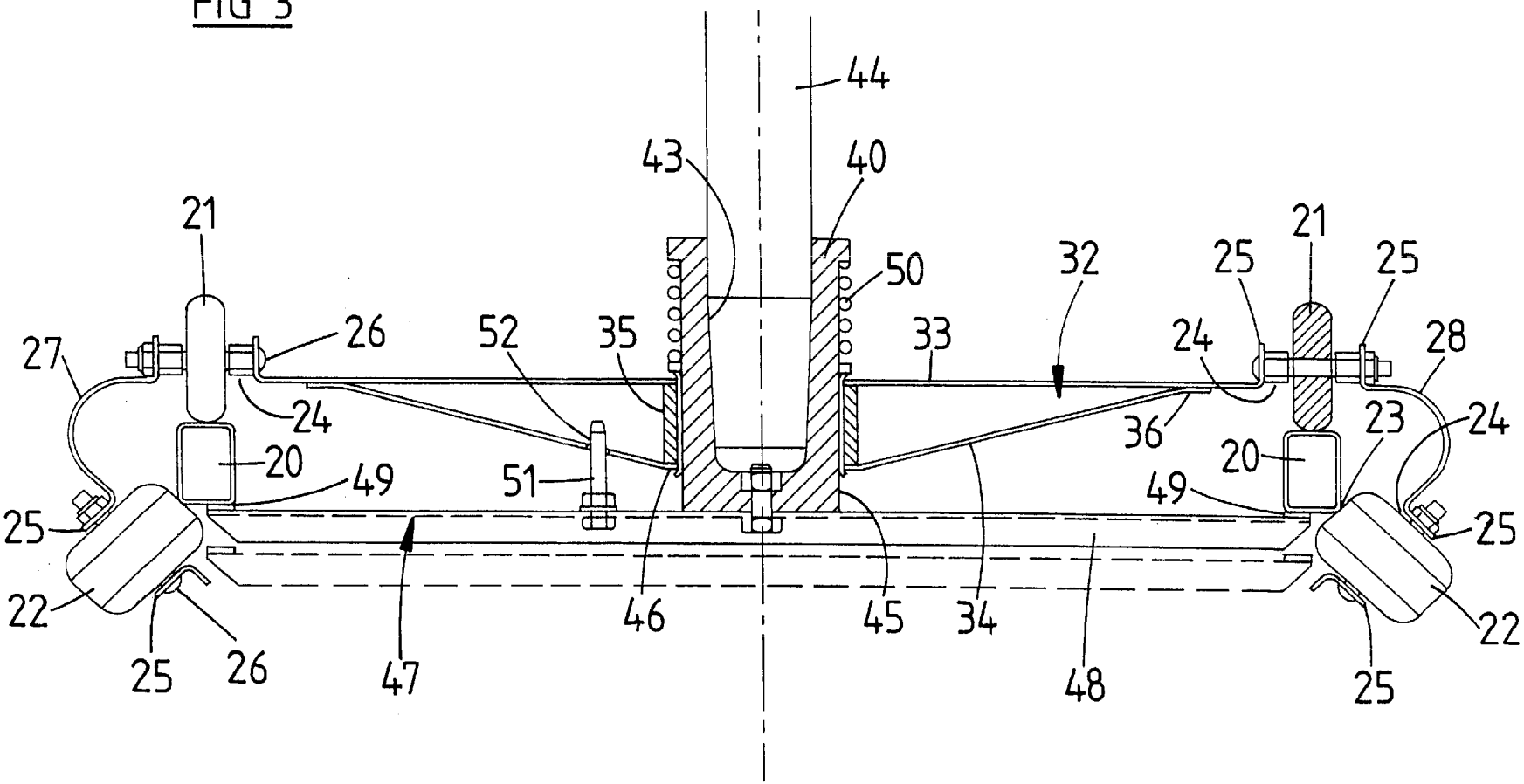
FIG. 3 is a partly sectioned side elevation of a chair base and part of a chair for lateral movement omitting the chassis members.

The subject matter of this disclosure pertains to an ergonomic chair. The chair includes a base, a pedestal and a seat. The base includes a friction reducing mechanism. The pedestal extends between the base and the seat. Any number of types of seat may be suitable for use with the disclosed base. The invention is therefore not limited to any particular seat.

As shown in FIG. 1, a base 10 for a chair includes two side chassis members 11. Each chassis member 11 supports, along a portion of its mid-section, the ends 13 of two parallel rods 12. The rods 12 may be up to several meters long if required. The rods 12 act to support a suitable form of bearing for linear motion along them. Alternatively, rails may be used in place of rods. Together with other known means for supporting a weight for linear motion the terms "rail" and "rod" are used as examples of landings.

Each chassis member also supports one end of a pivoting, adjustable footrest 14. The position of the footrest 14 is governed by a ratchet and pawl or detent mechanism 15 whereby the elevation of the footrest 14 may be maintained against the weight of the user, until it is adjusted.

The parallel rods 12 support a sliding carrier 16. The carrier 16 includes bearings 17 which slide on the rods 12 so that the carrier can traverse, laterally, a space between the chassis members 11 as shown by the arrows. The carrier 16 extends between the bearings 17. A chair support 18 is fixed to the carrier 16 and is shaped to receive the post or pedestal of a chair. Any suitable chair on a post or pedestal can in this way be incorporated onto the base. Where circumferential linear bearings 17 are used with ground rods 12, lateral motion is accomplished with little frictional resistance. In this example, four bearings 17 are provided.

As shown in the alternative construction of FIG. 2, the carrier 16 may be triangular and provided with three bearings 17, one on one rod 12 and two bearings 17 on the other rod 12. This reduces friction, weight and cost.

Another embodiment is depicted in FIGS. 3–6. As shown in those Figures, the rods 12 have been replaced with rails 20. In this example, rectangular tubes are used as rails 20. This allows friction reducing bearings to reside within rollers or wheels 21 rather than bear directly on the rails 20. Polymeric rollers or wheels 21 (e.g. nylon or urethane) which are supplied with bearings may be supported by a stamped and pressed sheet metal carrier 32. Roller blade and skateboard wheels may be suitable with little or no modification.

To prevent the rollers 21 from disengaging the rails 20, stabilizing rollers 22 are supported by the carrier 32. The stabilizing rollers 22 are maintained so that they engage the lower outside edge 23 of the rails 20. Openings 24 in the carrier 32 through which the rollers 21, 22 extend are punched directly into the sheet metal forming the carrier 32. The metal displaced from the forming of the openings 24 is used to form the ears 25 which support the axles or fasteners 26 which pass through the various rollers 21, 22.

In this example, a triangular carrier is used with three pairs of rollers 21, 22. The front and rear edges 27, 28 of the carrier 32 are provided with a radius so that the weight bearing rollers 21 and the stabilizing rollers 22 can be supported by the same stamped and pressed piece of sheet metal. This stamping 33 may be joined to a reinforcement, such as another stamped piece of sheet metal 34. Preferably, this is affixed to one end 46 of a rigid collar 35 formed in the centre of the carrier 32. The other extremity 36 of the reinforcement 34 is attached to the portion of the carrier 32 that supports the rollers 21, 22.

The opening of the collar 35 receives a taller collar 40. The collar 40 serves several purposes. Its main function is to receive and support the post or pedestal 44 of the seat 42 (not shown in FIG. 3). It has an internal bore 43, which may be tapered to receive a tapered pedestal 44. An end 45 of the collar 40 extends beyond the lower edge 46 of the collar 35. This end 45 attaches to a brake 47. The brake 47 comprises a rigid bar 48 that extends between the rails 20 (or rods 12). Each end of the bar 48 has brake pads 49 which engage the rails tightly when there is insufficient weight on the seat 42. When a predetermined weight is reached (when someone sits down) a compression spring 50 is overcome. The taller collar slides in the collar 35 against the resistance of the spring 50. This moves the brake 47 away from the rails 20 and allows the carrier 32 to move freely with respect to the rails 20. An alignment pin 51 extends from the brake bar 48 through a clearance hole 52 formed in the carrier 32. This keeps the brake 47 in alignment with the rails 20.

More direct means may be used to attach the pedestal 44 to the upper surface or part of the carrier 32.

To allow the entire base to slide in and out, the chassis members 11 are mounted on wheels or castors. As shown in FIG. 1, wheels or castors 60 may be mounted on or under the chassis members 11.

Figure 6:
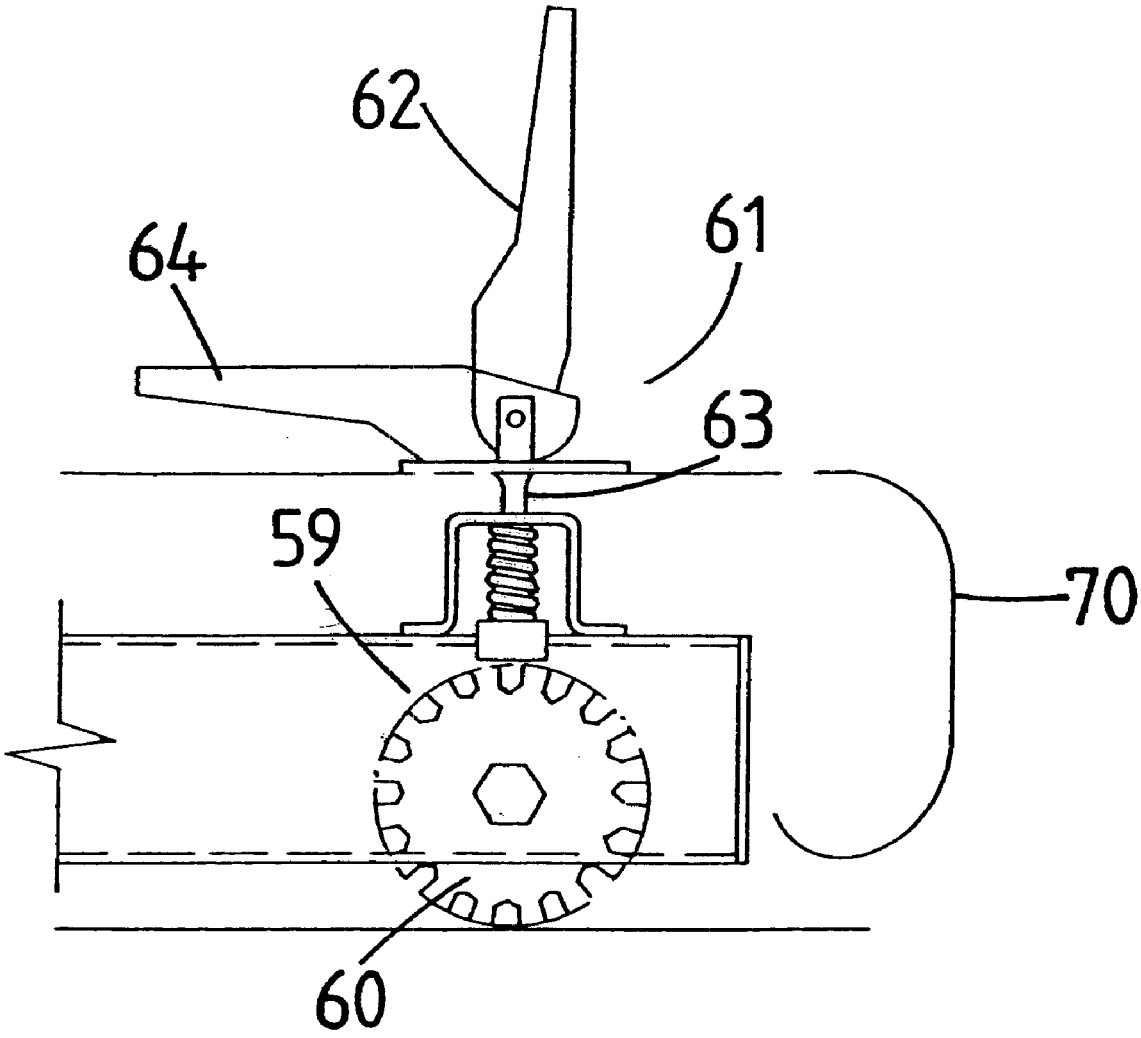
FIG. 6 is a side view of a lockable wheel assembly.

FIG. 6 illustrates a spring biased detent mechanism 61 for locking a wheel 60. The mechanism 61 includes a handle 62 which lifts a spindle 63 out of engagement with a wheel 60. The wheel 60 includes radial openings 59. In the "down" or "free" position 64, the spindle 63 is free of the wheel openings 59.

As shown in FIG. 4, the parallel rails 20 are supported at each end by chassis members 11. Each chassis member 11 may be equipped with wheels 60 so that the entire base may be rolled in and out.

As shown in FIG. 5, the base can include a rigid cover 70 with footrest features formed directly on it.

Figure 7:
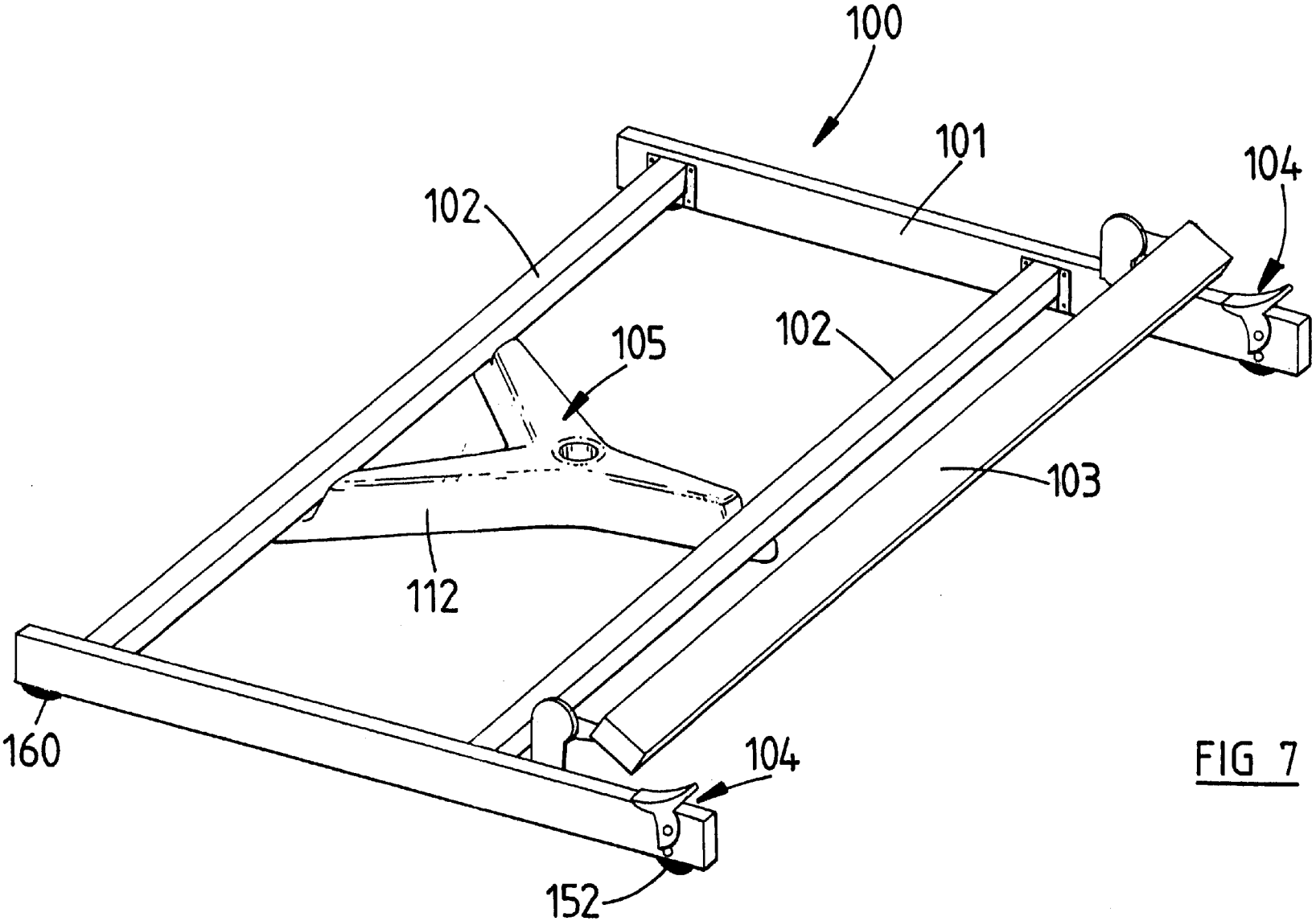
FIG. 7 is a perspective drawing of a chair base adapted to receive a chair for lateral movement.

Another embodiment is depicted in FIGS. 7–11. As shown in FIG. 7, the base 100 has chassis members 101 formed from rectangular steel tubes and two landings 102 formed from steel channel. Each chassis member 101 supports one end of an adjustable footrest 103. A retractable wheel assembly 104 is positioned on each chassis member, forward of the footrest 103. A carrier 105 rides on the landings 102, suspended from bogeys 111 (see FIGS. 8–10). The carrier 105 can be of cast metal.

Figure 8:
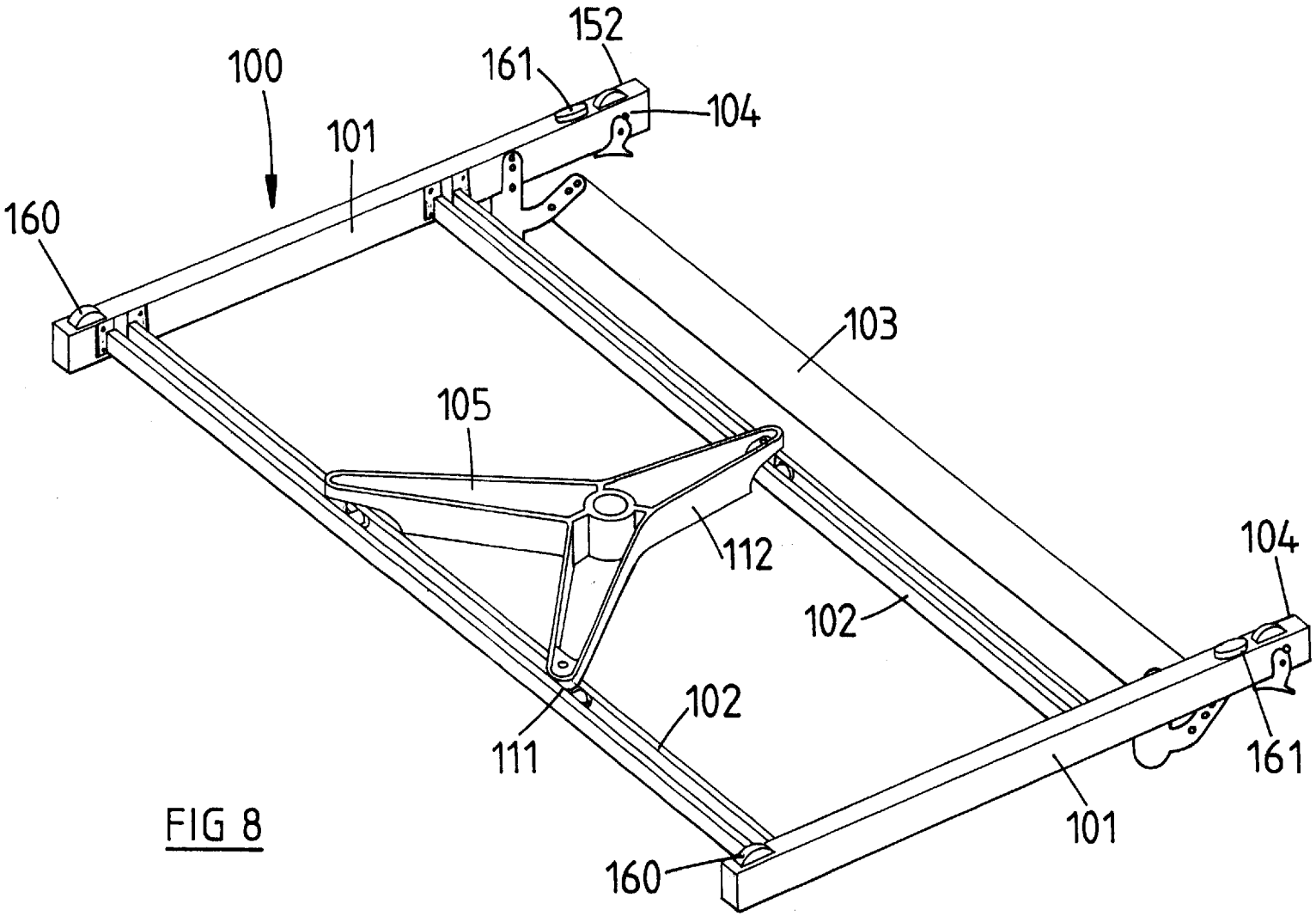
FIG. 8 is a perspective drawing of the inverted chair base of FIG. 7.
Figure 9:
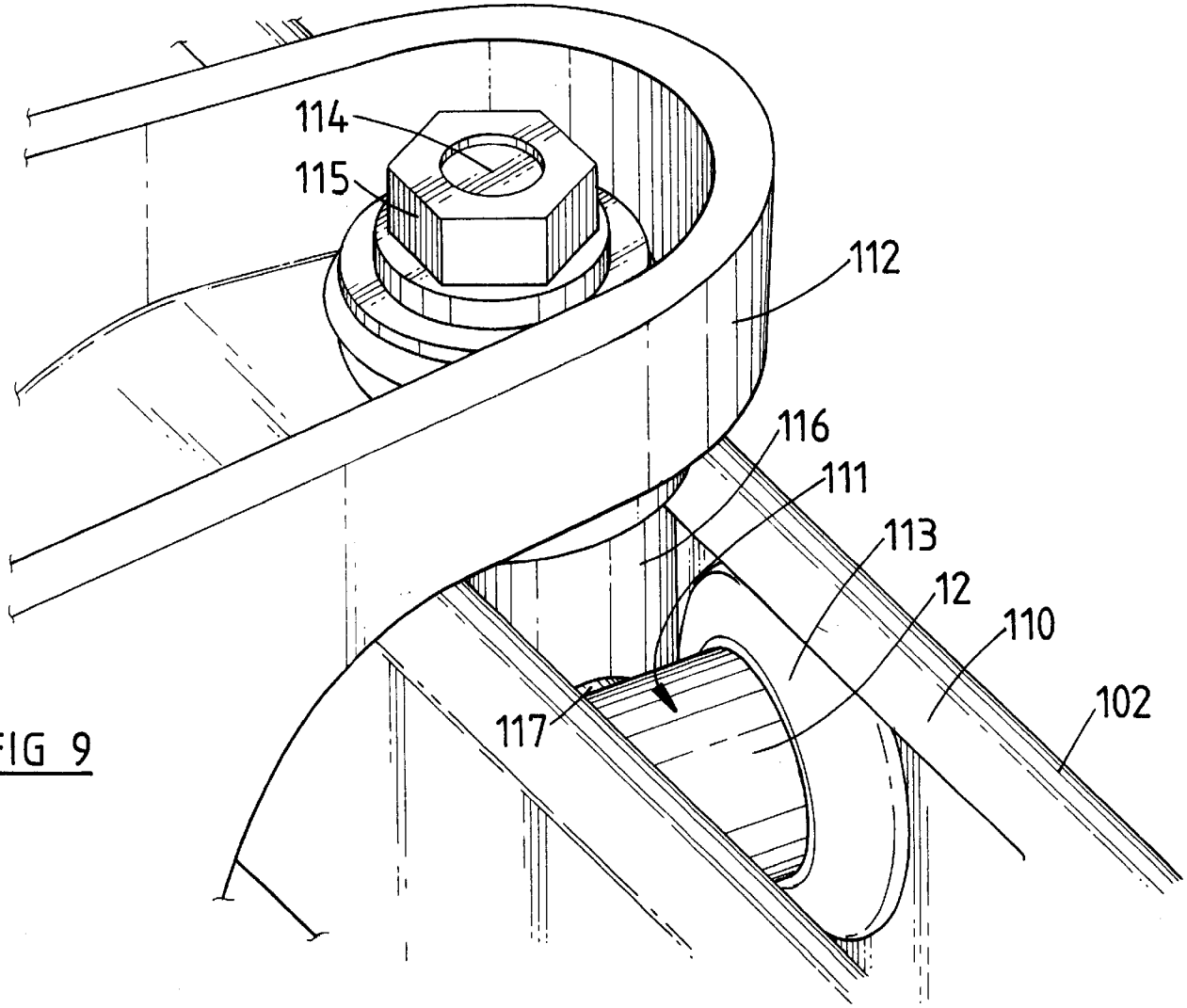
FIG. 9 is a perspective drawing of a bogey on a channel type landing.
Figure 10:
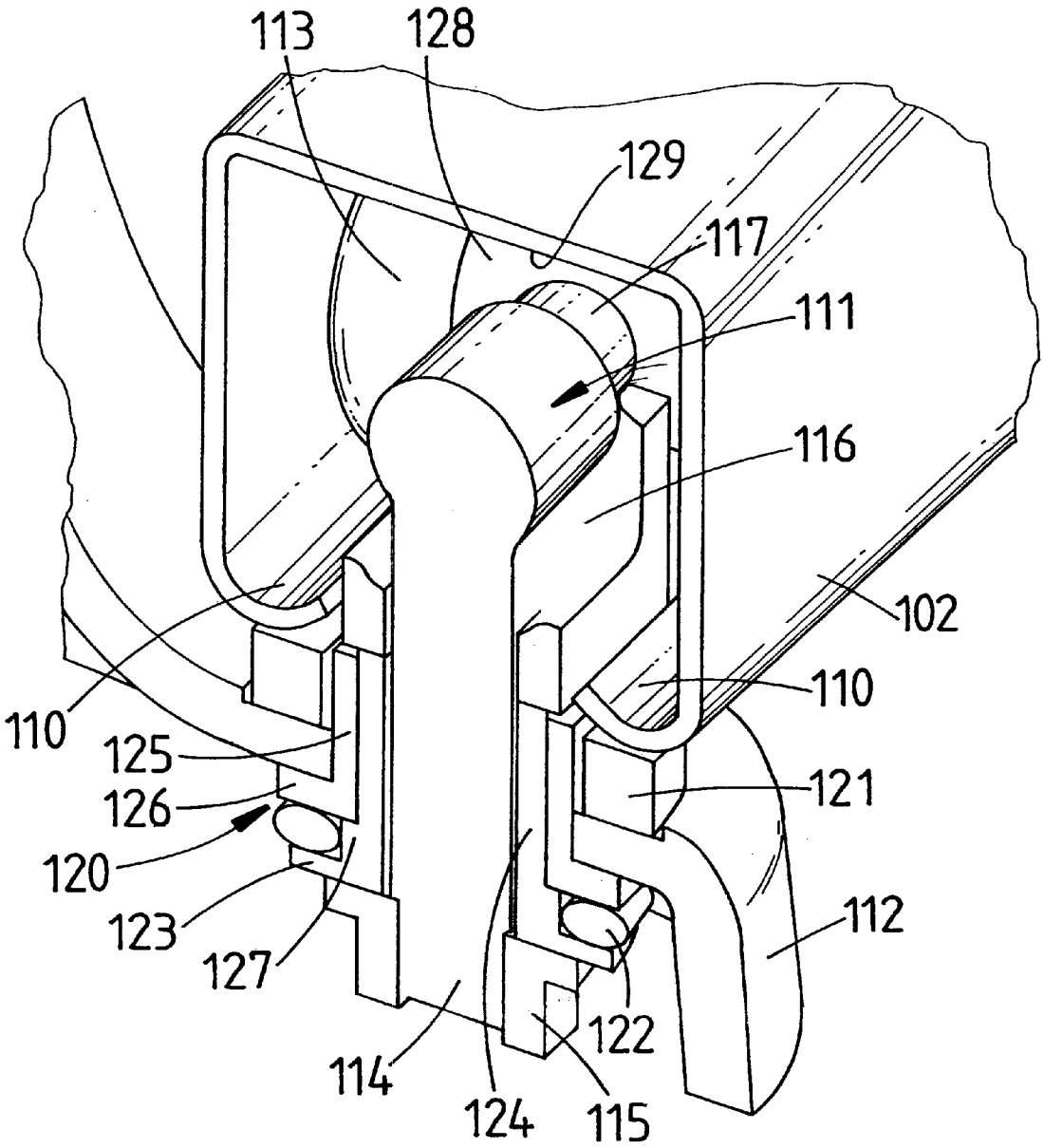
FIG. 10 is a cut away perspective drawing of an inverted bogey on a channel-type landing.

As shown in FIGS. 8, 9 and 10, each landing 102 is in the form of an inverted "U" shaped channel. Sides or edges 110 of the channel are bent inwards to form parallel grooves. The grooves serve as a track for wheeled bogeys 111. In this example, each of the three legs 112 of the carrier 105 is suspended from a four wheel bogey 111. A single groove landing in the form of a "J" could be employed and would be less expensive but less robust, more vulnerable to dust and dirt build up and less stable.

Each bogey 111 has two pairs of wheels 113 which are interconnected by a central tie 117.

A suspended threaded shaft 114 is affixed to the middle of the tie 117 and extends out of the channel 102. The carrier leg 112 is slidably affixed to the threaded shaft 114 by a nut 115. A yoke 116 distributes the load imposed by the tightened nut 115 bearing on the sleeve 124, and bears on the ends of the tie 117. In the case of the single front leg 112 in this example (as shown in FIG. 7), a single brake mechanism 120 (FIG. 10) is provided between the nut 115 and the yoke 116. The brake mechanism 120 includes an O-ring 122. The nut 115 bears directly on a first flange 123 formed on the end of a sleeve 124 which fits around the shaft 114. A sliding sleeve 125 has a second flange 126. Under load, the front leg 112 acts on the second flange 126 to compress the O-ring 122 until the sliding sleeve 125 bottoms out against a shoulder 127 defined by the sleeve 124. When a person gets off the seat, the O-ring expands to its original shape and urges the carrier mounted circumferential urethane pad 121 into contact with the channel 102. This acts as a safety brake when there is no load and inhibits the carrier from sliding on the landings.

Each end of the tie 117 is affixed to a pair of wheels 113. In one embodiment, the wheels 113 have a metal core and a polymeric contact surface. Each wheel 113 is mounted, via bearings, on a cross shaft 128. The small clearance between the top of the wheels 113 and the interior top 129 of the channel prevents excessive motion of the bogey.

Figure 11:
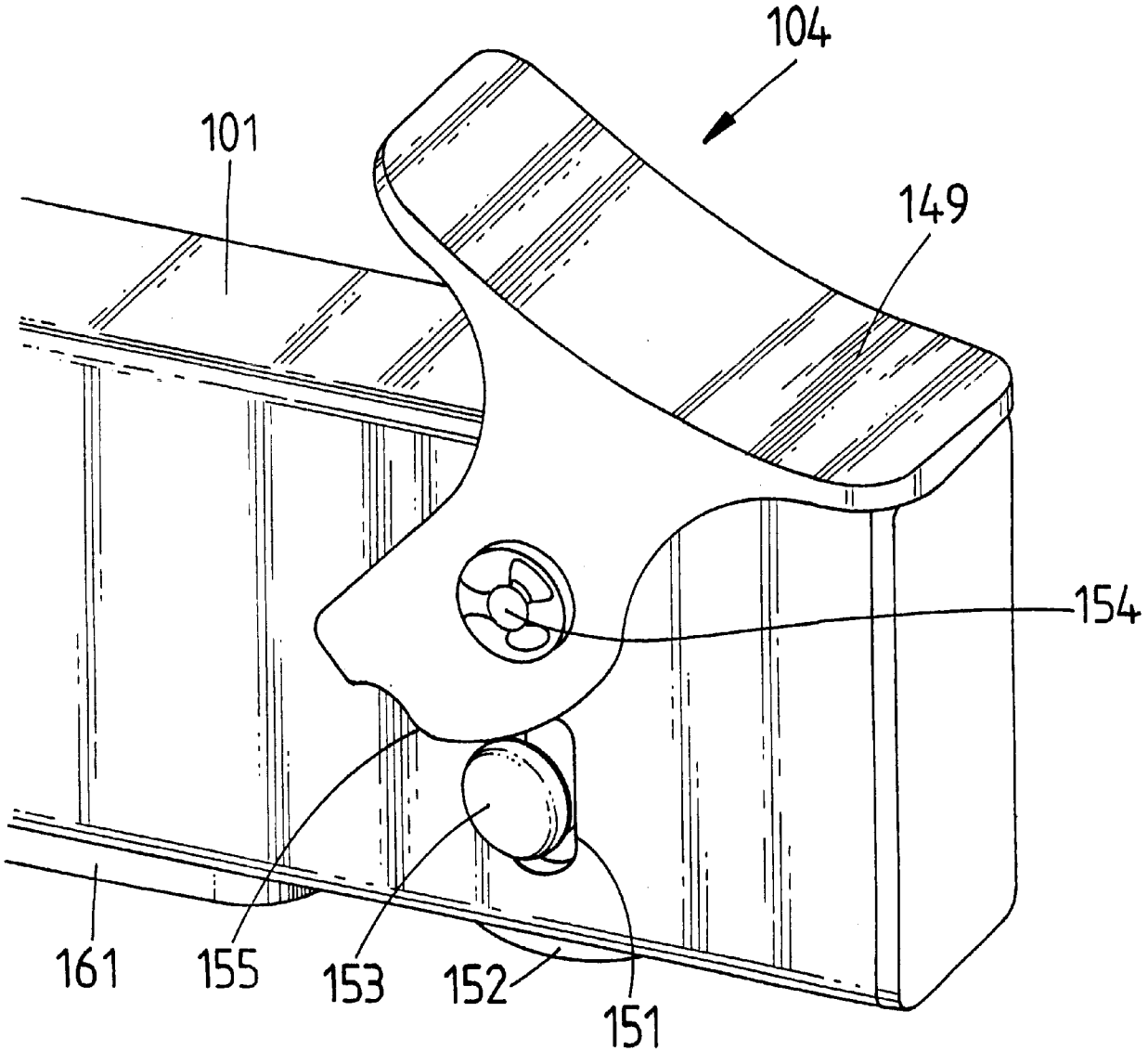
FIG. 11 is a perspective drawing of a retractable wheel assembly.

FIG. 11 illustrates a retractable wheel assembly 104 mounted within a forward portion of a chassis member 101. The assembly 104 utilises a pair of vertical slots 151 to trap the shaft 153 of a retractable wheel 152. The wheel is normally biased into a retracted position (as shown) and may be deployed with a foot pedal 149. The foot pedal 149 pivots about a shaft 154. A cam surface 155 urges the wheel down and into contact with the ground and maintains it there when the foot pedal 149 is depressed. This allows the entire base 100 to be wheeled forward and back (ie in and out) on its four wheels 152, 160 (see FIG. 8). When the wheels 152 are retracted, the base 100 rests on its rear wheels 160 and front pads 161.

Further, it should be understood that the various embodiments of the invention disclose different components and alternatives which are considered compatible with one another for the purposes of chair construction.

The present invention has been described with reference to particular details of manufacturing. It should be appreciated that these are provided by way of example and not as limitations to the scope or spirit of the invention.

It will of course be realised that the above has been given only by way of illustrative example of the invention and that all such modifications and variations thereto as would be apparent to persons skilled in the art are deemed to fall within the broad scope and ambit of the invention as is herein set forth.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

What is claimed is:

1. A base for a seat or chair comprising:

a chassis;

a landing provided on the chassis;

a carrier slidable in a first direction along the landing, the carrier being adapted to support, or capable of supporting, a seat or chair facing, or able to face, in a second direction which is at about 90 degrees to said first direction; and a carrier braking means having a friction material that is movable towards and away from the landing, the braking means being such that the carrier can only be freely slid along the landing when the braking means is released, the braking means being releasable by the weight of an occupied seat or chair that serves to move the friction material away from contact with the landing and thus release the braking means, which is otherwise adapted to cause the friction material to remain in contact with the landing.

2. A base according to claim 1, wherein the carrier braking means includes a compressible member adapted to be compressed by the weight of the occupied seat or chair to move the friction material away from contact with the landing.

3. A base according to claim 2, wherein the chassis is provided with means to facilitate the chassis being moved in the second direction and in a third direction substantially opposite the second direction.

4. A base according to claim 3, wherein said means includes wheels that are retractable with respect to the chassis.

5. A base according to claim 3, wherein said means include lockable wheels.

6. A base according to claim 1 wherein the landing is defined by spaced rails.

7. A base according to claim 6 wherein the carrier is supported by wheels, which are positioned on said rails to permit movement of the carrier with respect to said rails.

8. A base according to claim 1 in a combination, wherein said carrier supports a seat or chair facing, or able to face, the second direction.

9. A base for a seat or chair, the base comprising:

a support structure;

a carrier that is arranged on the support structure, a seat or chair being mountable on the carrier to be supported above the support structure;

a linear displacement mechanism to permit linear displacement of the carrier relative to the support structure;

a brake mechanism that is arranged between the carrier and the support structure to inhibit linear displacement of the carrier relative to the support structure; and biasing means for biasing the brake mechanism into an operative condition when the seat or chair is not in use, the biasing means being overcome when a threshold weight bears on the carrier, said threshold weight being based on a selected minimum weight of a person envisaged using the seat or chair.

10. A base according to claim 9, in which a number of wheels are mounted on the support structure to facilitate movement of the support structure relative to a substrate.

11. A base according to claim 10, which includes a retracting mechanism that is operable on the wheels to retract the wheels.

12. A base according to claim 10, which includes a locking mechanism that is operable on the wheels to lock the wheels against rotational movement.

13. A base according to claim 9, in which the support structure includes at least two spaced, substantially parallel, elongate members, the carrier being supported on the elongate members and being displaceable along the elongate members, the elongate members being of sufficient length to provide a desired extent of movement of the carrier.

14. A base according to claim 13, in which the carrier includes at least two engaging formations that are slidably engaged with respective elongate members so that the carrier is slidable with respect to the elongate members.

15. A base according to claim 13, in which the elongate members are circular cylindrical and the engaging formations are in the form of collars that are slidably mounted on the respective elongate members.

16. A base according to claim 13, in which the carrier includes at least two wheel arrangements, each wheel arrangement including a weight bearing roller that is rotatably engaged with a respective elongate member so that the carrier can be wheeled back and forth along the elongate members.

17. A base according to claim 16, in which each elongate member is shaped to define an operatively upper support surface on which the respective weight bearing rollers are supported.

18. A base according to claim 17, in which each wheel arrangement includes a guide roller that is engageable with a respective elongate member to guide movement of the carrier on the elongate members.

19. A base according to claim 16, in which each elongate member defines a suspension track and each wheel arrangement defines a bogey that is positioned on a respective track, the carrier being suspended from the bogeys.

20. A chair in combination with said base as claimed in claim 9.

21. A base according to claim 2, wherein the landing is defined by spaced rails.

22. A base according to claim 3, wherein the landing is defined by spaced rails.

23. A base according to claim 21, wherein the carrier is supported by wheels, which are positioned on said rails to permit movement of the carrier with respect to said rails.

24. A base according to claim 22, wherein the carrier is supported by wheels, which are positioned on said rails to permit movement of the carrier with respect to said rails.

25. A base according to claim 3 in a combination, wherein said carrier supports a seat or chair facing, or able to face, an "in" direction which at 90 degrees to said "sideways" direction.

26. A base according to claim 7 in a combination, wherein said carrier supports a seat or chair facing, or able to face, an "in" direction which at 90 degrees to said "sideways" direction.

27. A base according to claim 11, which includes a locking mechanism that is operable on the wheels to lock the wheels against rotational movement.

28. A base according to claim 10, in which the support structure includes at least two spaced, substantially parallel, elongate members, the carrier being supported on the elongate members and being displaceable along the elongate members, the elongate members being of sufficient length to provide a desired extent of movement of the carrier.

29. A base according to claim 11, in which the support structure includes at least two spaced, substantially parallel, elongate members, the carrier being supported on the elongate members and being displaceable along the elongate members, the elongate members being of sufficient length to provide a desired extent of movement of the carrier.

30. A base according to claim 12, in which the support structure includes at least two spaced, substantially parallel, elongate members, the carrier being supported on the elongate members and being displaceable along the elongate members, the elongate members being of sufficient length to provide a desired extent of movement of the carrier.

31. A base according to claim 14, in which the elongate members are circular cylindrical and the engaging formations are in the form of collars that are slidably mounted on the respective elongate elements.

32. A chair in combination with said base as claimed in claim 13.

* * * * *

UNITED STATES PATENT AND TRADEMARK OFFICE

CERTIFICATE OF CORRECTION

PATENT NO. : 6,505,804 B1 
DATED : January 14, 2003
INVENTOR(S) : Simon Leigh Francis et al.

It is certified that error appears in the above-identified patent and that said Letters Patent is hereby corrected as shown below:

Column 1,
Line 4, insert -- BACKGROUND OF THE INVENTION --.
Line 5, insert -- Description of Related Art --.
Line 21, insert -- BRIEF SUMMARY OF THE INVENTION --.

Column 2,
Line 43, delete the "," after "there".
Line 56, insert -- BRIEF DESCRIPTION OF THE SEVERAL VIEWS OF THE DRAWING --.

Column 3,
Line 8, insert -- DETAILED DESCRIPTION OF THE INVENTION --.

Signed and Sealed this

Eleventh Day of November, 2003

JAMES E. ROGAN
*Director of the United States Patent and Trademark Office*